US008113342B2

(12) United States Patent
Sonoda et al.

(10) Patent No.: US 8,113,342 B2
(45) Date of Patent: Feb. 14, 2012

(54) INSTRUMENT HOUSING CASE

(75) Inventors: Jiro Sonoda, Shimada (JP); Takuji Kishita, Shimada (JP); Sumito Yamagishi, Shimada (JP)

(73) Assignee: Sakai Composites Corp., Shizuoka (JP)

( * ) Notice: Subject to any disclaimer, the term of this patent is extended or adjusted under 35 U.S.C. 154(b) by 0 days.

(21) Appl. No.: 12/764,241

(22) Filed: Apr. 21, 2010

(65) Prior Publication Data

US 2011/0259764 A1 Oct. 27, 2011

(51) Int. Cl.
*A45C 11/00* (2006.01)

(52) U.S. Cl. ..... 206/14; 206/314; 206/521

(58) Field of Classification Search ..... 206/14, 206/314, 521, 523, 591; 220/212.5, 213, 220/252, 253, 810; 229/164; 84/274, 278
See application file for complete search history.

(56) References Cited

U.S. PATENT DOCUMENTS 306,731 A * 10/1884 Fairbanks ..... 206/314
3,326,359 A * 6/1967 Katz ..... 206/14
4,531,632 A * 7/1985 Weber ..... 206/14
4,846,340 A * 7/1989 Walther ..... 206/14
5,669,495 A * 9/1997 West ..... 206/314
6,029,804 A * 2/2000 Flynn ..... 206/14
6,959,810 B2 * 11/2005 Neilson ..... 206/314
D564,031 S * 3/2008 Perella et al. ..... D19/90

FOREIGN PATENT DOCUMENTS

JP 2004-61802 2/2004

* cited by examiner

*Primary Examiner* — Luan K Bui
(74) *Attorney, Agent, or Firm* — Smith, Gambrell & Russell, LLP

(57) ABSTRACT

Provided is an instrument housing case, which is capable of preventing an instrument from falling down, and which is capable of achieving a reduction in weight. The instrument housing case (10) houses an instrument long in one direction, and includes: a main body case (20) which is defined by an upper surface (21) and a lower surface (22) each having a larger width, and both side surfaces (23 and 24) each having a smaller width and both end surfaces (25 and 26) closing, to thereby form a cylindrical shape as a whole, the main body case including an opening portion (27) cut out a portion ranging from a middle portion in a longitudinal direction of the upper surface (21) through a middle portion in a longitudinal direction of each of the both side surfaces (23 and 24) to a vicinity of one end surface (25); and a cover body (30) which forms a shape adapted for the opening portion (27) of the main body case (20) and which is pivotably fixed through a hinge (40) to an edge portion of the opening portion (27) in the upper surface (21) of the main body case (20), the edge portion being away from the end surface (25).

13 Claims, 13 Drawing Sheets

INSTRUMENT HOUSING CASE

BACKGROUND OF THE INVENTION

1. Field of the Invention

The present invention relates to an instrument housing case, which allows an instrument such as a violin or a cello to be readily taken in and out of the instrument housing case even in a limited space.

2. Description of the Related Art

Conventionally, various instruments are carried while being housed in a predetermined case. Among the instruments, stringed instruments, such as a violin and a cello, which are long in one direction, are generally housed in the following case.

That is, there has been widely used a case, which includes: a main body case having a longitudinal box shape, which extends along a longitudinal direction of the instrument; and a cover body, which is fixed to one side along a longitudinal direction of the case through hinges so as to be opened and closed. Further, by opening the cover body in a lateral direction with respect to the main body case, the main body case is opened so as to allow the instrument to be taken in and out of the case.

As the laterally-openable case described above, for example, Japanese Patent Application Laid-open No. 2004-61802 to be described below discloses a stringed instrument case including: a main body case (case body) that is formed in a rectangular box-like shape whose upper portion is opened; a cover body; a body fixing member for fixing a body of the stringed instrument therein; and a neck fixing member for fixing a neck of the stringed instrument therein. Further, in a fitting line between the main body case and the cover body, there are provided fasteners (locks) for holding the cover body in a closed state with respect to the main body case. Further, after the fasteners are unlocked, the cover body is laterally opened with respect to the main body case, and then the instrument is taken in and out of the case.

In Japanese Patent Application Laid-open No. 2004-61802, the instrument housing case allowing the instrument to be taken in and out of the instrument housing case is generally provided with the fasteners for holding the cover body in a closed state with respect to the main body case. However, there is risk in that, in a case where the instrument housing case is lifted up in a state in which the fasteners are left unlocked, or in a case where the fasteners are forced to be unlocked during conveyance, the cover body is widely and laterally opened with respect to the main body case with a result in which the instrument falls out of the main body case.

In addition, the above-mentioned instrument housing case has a structure in which the cover body is widely and laterally opened with respect to the main body case and is closed with respect to the main body case in such a manner that a limb portion of the cover body comes into contact with a limb of an opening portion of the main body case. However, it is relatively difficult for peripheral wall portions of the main body case and the cover body, which are opened and closed and come into contact with each other, to ensure their stiffness, and hence those portions need often to be increased in wall thickness. That leads to an increase in weight of the instrument housing case.

SUMMARY OF THE INVENTION

Therefore, it is an object of the present invention to provide an instrument housing case, which is capable of preventing the instrument from falling down, and which is capable of achieving a reduction in weight.

In order to achieve the above-mentioned object, according to the present invention, there is provided an instrument housing case for housing an instrument which is long in one direction, the instrument housing case including: a main body case which is defined by an upper surface and a lower surface each having a larger width, and both side surfaces each having a smaller width and both end surfaces closing, to thereby form a cylindrical shape as a whole, the main body case including an opening portion cut out a portion ranging from a middle portion in a longitudinal direction of the upper surface through a middle portion in a longitudinal direction of each of the both side surfaces to a vicinity of one of the end surfaces; and a cover body which forms a shape adapted for the opening portion of the main body case and which is pivotably fixed through a hinge to an edge portion of the opening portion in the upper surface of the main body case, the edge portion being away from the one of the end surfaces.

According to the above-mentioned invention, it is possible to open the cover body so as to take the instrument in and out of the instrument housing case through the opening portion of the main body case. Since the instrument is housed in the main body case including the both end surfaces closing so as to form a cylindrical shape as a whole, the instrument does not easily bounce out from the opening portion and the instrument can be prevented from falling out of the instrument housing case even in a case where the instrument housing case is lifted up in a state in which fasteners are left unlocked after the cover body is closed, or even in a case where the fasteners are forced to be unlocked during conveyance.

Further, the main body case forms the cylindrical shape as a whole, in which the upper surface and the both side surfaces of the main body case are partially opened, and the opening portion is covered with the cover body. Thus, in comparison with a conventional instrument housing case having a lower case and an upper case to open and close, it is easier to maintain the stiffness of the instrument housing case even when the instrument housing case has a relatively light weight. Therefore, it is possible to achieve a reduction in weight of the instrument housing case.

In the instrument housing case according to the present invention, it is preferred that the instrument housing case be formed of a resin reinforced with woven fabric containing carbon fiber. According to this aspect, it is possible to provide an instrument housing case having light weight and high stiffness.

In the instrument housing case according to the present invention, it is preferred that the opening portion be defined by: portions extending along a width direction of the instrument housing case in the middle portion in the longitudinal direction of the upper surface and in the vicinity of one of the end surfaces of the main body case; portions extending along a longitudinal direction of the instrument housing case in middle portions in a height direction of the both side surfaces of the main body case; and obliquely inclined portions linking both ends of the portions extending in the width direction of the upper surface and both ends of the portions extending in the longitudinal direction of the both side surfaces to each other, and that each of the obliquely inclined portions be inclined toward a center of each of the portions extending in the longitudinal direction of the instrument housing case. According to this aspect, it is possible to set the opening portion of the main body case to be large as possible, and to maintain strength of the main body case because of the obliquely inclined portions.

In the instrument housing case according to the present invention, it is preferred that the instrument include a rubbed string instrument including: a main body portion; a neck extending from the main body portion; a bridge portion arranged on a front side of the main body portion; a string tensioned through the bridge portion on the front side of the main body portion and on a front side of the neck; and a chinrest fixed with an end pin to an end portion of the main body portion on a side opposite to the neck, that a first retaining portion for supporting a vicinity of the end pin be provided in an inner periphery of one of the end surfaces of the main body case, which is away from the opening portion, that a second retaining portion for sandwiching the neck be provided on an inner surface of the main body case, which is opposed to the cover body, and on an inner surface of the cover body, and that an area in which a painted surface of the instrument is held in contact with an inner surface of the instrument housing case be set to be 10% or less of an entire of the painted surface. According to this aspect, the instrument is retained by the first retaining portion for supporting the vicinity of the end pin and the second retaining portion for sandwiching the neck, and the painted surface of the instrument is prevented, as much as possible, from being held in contact with the inner surface of the instrument housing case. Thus, it is possible to avoid a disadvantage in that the painted surface is damaged or has marks generated due to adhesion of a cushion member.

In one aspect of the instrument housing case according to the present invention, it is preferred that the second retaining portion include: a first holding member, which is fixed on the inner surface of the cover body, and holds a back surface side of the neck of the instrument; and a second holding member, which is fixed on the inner surface of the main body case, and with which a fingerboard provided on the front side of the neck of the instrument comes into contact, and that the fingerboard be supported in substantially parallel to the inner surface of the main body case. According to this aspect, the back surface portion (not painted portion) of the neck is held by the first holding member and the fingerboard (portion formed of material resistant to damages and marks) is held by the second holding member. Thus, it is possible to retain the instrument in a state in which the painted surface thereof is not held in contact with any part. Further, the fingerboard is supported in substantially parallel to the inner surface of the main body case, and hence it is possible to efficiently house the rubbed string instrument in the instrument housing case because of a decrease in an unnecessary space, and to retain more stably the instrument in the instrument housing case.

In another aspect of the instrument housing case according to the present invention, it is preferred that the second retaining portion include: a first holding member, which is fixed on the inner surface of the cover body, and holds a front surface side of the neck of the instrument; and a second holding member, which is fixed on the inner surface of the main body case, and supports a back surface side of the neck of the instrument, and that the front surface side of the neck of the instrument be arranged on a side of the opening portion of the main body case. According to this aspect, the back surface side of the neck is held by the second holding member and the front surface side of the neck is held by the first holding member. The front surface side of the neck of the instrument is arranged on the opening portion side of the main body case. As a result, it is easier to check positions of the strings with respect to the instrument housing case. Therefore, it is possible to take the instrument in and out of the instrument housing case while taking care to prevent the strings from coming into contact with the inner surface of the instrument housing case.

In the instrument housing case according to the present invention, it is preferred that, between the first retaining portion and the second retaining portion in the inner surface of the main body case, which is opposed to the cover body, a recessed portion for arranging the bridge portion of the rubbed string instrument while preventing the bridge portion from coming into contact with the inner surface of the instrument housing case be formed. According to this aspect, the recessed portion for arranging the bridge portion of the rubbed string instrument while preventing the bridge portion from coming into contact with the inner surface of the instrument housing case is formed between the first retaining portion and the second retaining portion. Thus, when the rubbed string instrument is taken in and out of the instrument housing case, the bridge portion is not allowed to readily come into contact with the inner surface of the instrument housing case. Further, when the instrument is housed in the instrument housing case, it is possible to retain the bridge portion while preventing the bridge portion from coming into contact with the inner surface of the instrument housing case, to thereby effectively protect the bridge portion.

In the instrument housing case according to the present invention, it is preferred that, in a vicinity of one of the end surfaces in the lower surface of the main body case, which is away from the opening portion, an inclined surface gradually increasing in height toward the one of the end surfaces so as to reach to the first retaining portion be provided. According to this aspect, when the rubbed string instrument is housed in the instrument housing case so that the end pin is first inserted therein, the end pin of the rubbed string instrument is guided by the inclined surface, and moves gradually into the instrument housing case. Then, the thin neck, which extends from the main body portion, is arranged substantially along the inner surface of the main body case. At the same time, the end pin is lifted up toward the inside of the instrument housing case with respect to the neck. Thus, in the above-mentioned state, it is possible to house and retain the rubbed string instrument in a balanced and stable posture in the instrument housing case.

In the instrument housing case according to the present invention, it is preferred that the first holding member be structured so as to come into contact with an edge portion, which is on a side opposite to the end pin of the main body portion of the instrument, from a back surface side of the instrument when the cover body is closed, to thereby hold the main body portion against the first retaining portion. According to this aspect, the vicinity of the end pin of the main body portion of the instrument is supported by the first retaining portion, and the edge portion on the side opposite to the end pin is held and retained by the first holding member against the first retaining portion. Therefore, the both ends of the main body portion of the instrument are securely supported, and it is possible to more stably retain the instrument in the instrument housing case.

In the instrument housing case according to the present invention, it is preferred that bow-retaining portions be provided on both sides of the inner surface of the main body case, which is opposed to the cover body, that each of the bow-retaining portions include: a guide wall portion for regulating both side positions of a bow; and a fixture for detachably fixing the bow to the inner surface, and that at least one of the guide wall portions include a cavity therein so as to house components therein. According to this aspect, the bow can be retained in the bow-retaining portion. Further, it is possible to house components such as the bow in the cavity in the inside of the guide wall portion, and hence it is possible to increase a convenience for a user of the instrument housing case.

In the instrument housing case according to the present invention, it is preferred that the instrument housing case further include: a grip handle provided in a center portion of one of the both side surfaces of the main body case so as to be gripped for carrying the instrument housing case in a laid posture; and a shoulder strap used for carrying the main body case on the back of a user of the instrument housing case in a state in which a longitudinal direction of the main body case is oriented in a vertical direction, the shoulder strap including both ends fixed to two portions away from each other in the longitudinal direction of the main body case or fixed to two portions away from each other in the longitudinal direction of the main body case and the cover body. According to this aspect, it is possible not only to carry the instrument housing case in the laid posture while gripping the grip handle of the main body case, but also to retain the instrument housing case remaining arranged in the upright posture by slinging the shoulder strap over the shoulder of a user. Further, when the instrument housing case remaining arranged in the upright posture is retained, the one end surface of the main body case is upwardly oriented, and hence it is possible to prevent rain water and the like from readily getting into the instrument housing case.

In the instrument housing case according to the present invention, it is preferred that protection layers formed of an elastic resin be formed in corner portions of the end surfaces in the longitudinal direction of the main body case. According to this aspect, when impact force is applied on the instrument housing case, for example, due to falling of the instrument housing case, it is possible to alleviate the impact force so as to prevent the instrument housing case from being damaged.

According to the present invention, since the instrument is housed in the main body case including the both end surfaces closing so as to form a cylindrical shape as a whole, the instrument does not easily bounce out from the opening portion and the instrument can be prevented from falling out of the instrument housing case even in a case where the instrument housing case is lifted up in a state in which fasteners are left unlocked after the cover body is closed, or even in a case where the fasteners are forced to be unlocked during conveyance. Further, the main body case forms the cylindrical shape as a whole, in which the upper surface and the both side surfaces of the main body case are partially opened, and the opening portion is covered with the cover body. Thus, in comparison with a conventional instrument housing case having a lower case and an upper case to open and close, it is easier to maintain the stiffness of the instrument housing case even when the instrument housing case has a relatively light weight. Therefore, it is possible to achieve a reduction in weight of the instrument housing case.

DETAILED DESCRIPTION OF THE PREFERRED EMBODIMENTS

Hereinafter, with reference to FIGS. 1 to 10, an instrument housing case according to one embodiment of the present invention is described.

Figure 1:
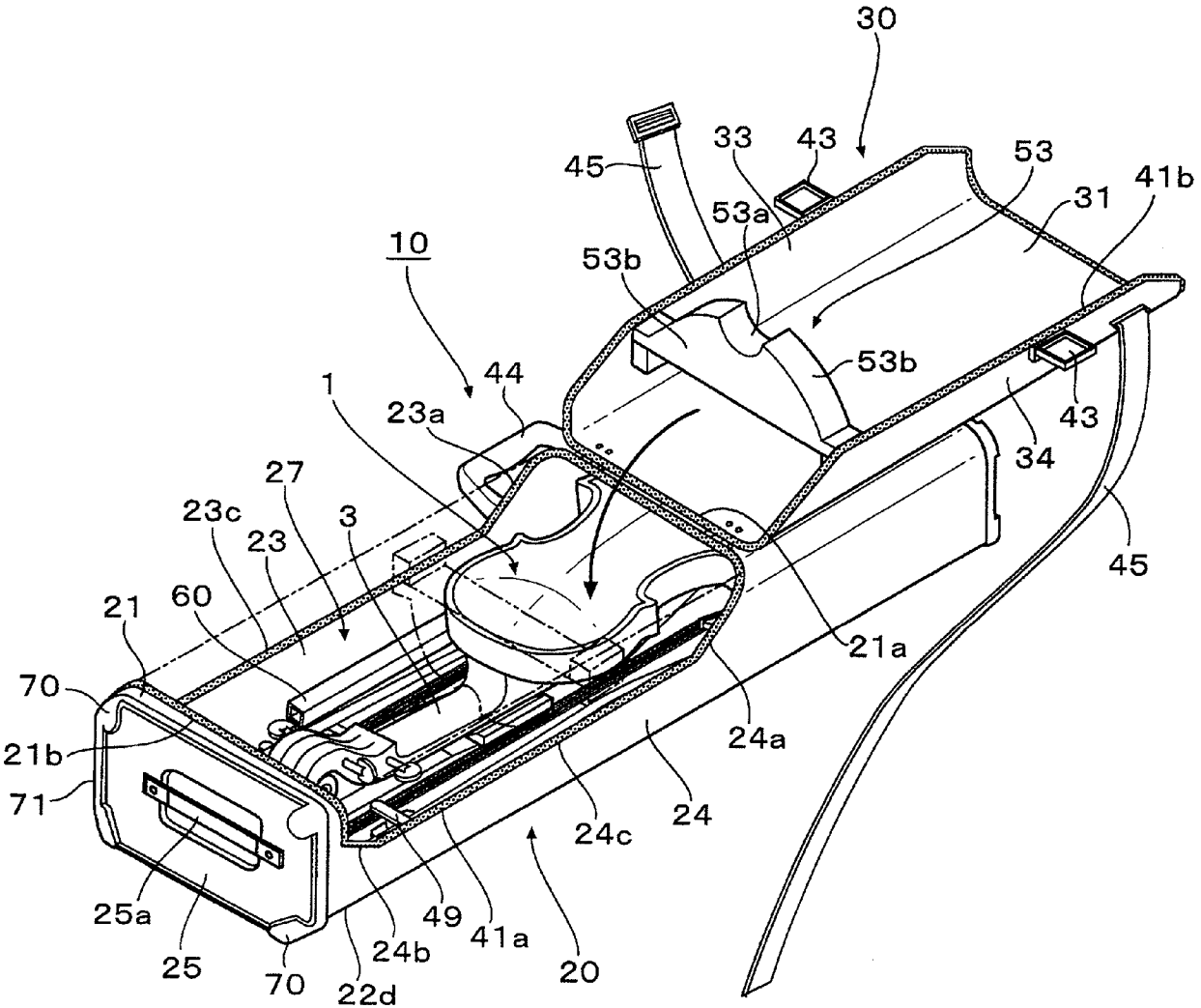
FIG. 1 is a perspective view of an instrument housing case according to one embodiment of the present invention.
Figure 2:
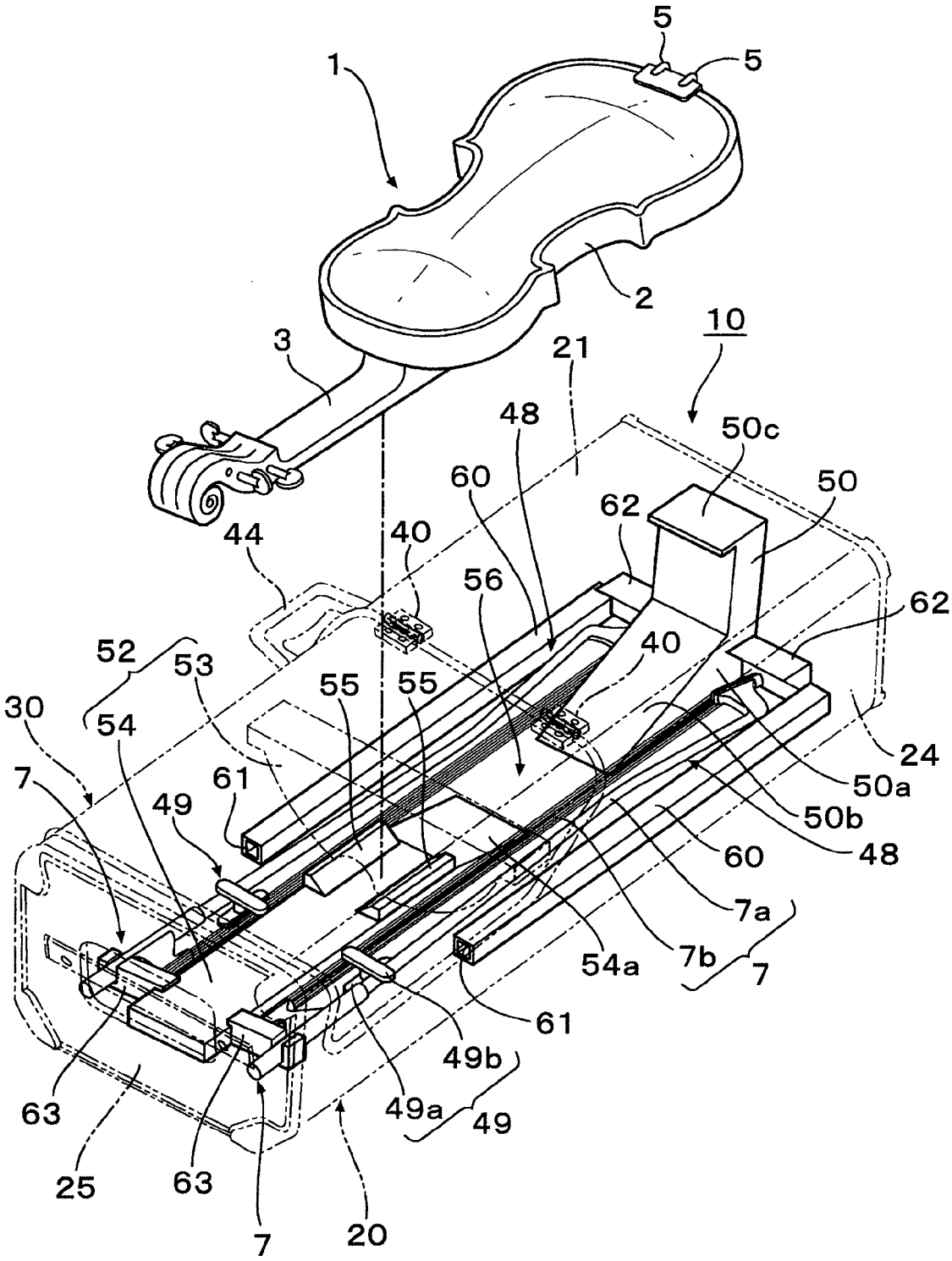
FIG. 2 is a transparent perspective view of the instrument housing case according to the embodiment of the present invention.

The instrument housing case houses an instrument which is long in one direction. The instrument housing case allows the instrument to be taken in and out of the instrument housing case in a state in which the instrument housing case is placed while its longitudinal direction is oriented in a vertical direction with respect to a placement surface. As illustrated in FIG. 1 and FIG. 2, the instrument housing case 10 includes a main body case 20 and a cover body 30. The main body case 20 includes an opening portion 27. The cover body 30 is pivotably fixed to the main body case 20 through hinges 40, and covers the opening portion 27 so as to open and close the same.

Further, as the instrument, which is long in one direction and is housed in the instrument housing case 10, there are exemplified a so-called rubbed string instrument such as a violin, a cello, or a contrabass, and a so-called plucked string instrument such as a guitar, a koto (long Japanese zither with thirteen strings), or a biwa (four-stringed Japanese lute). Of those instruments, a rubbed string instrument as illustrated in FIG. 9 is preferred. Specifically, such a rubbed string instrument includes: a main body portion 2; a neck 3 extending from one side in a longitudinal direction of the main body portion 2; a fingerboard 4 provided by a predetermined length over a front surface side of the neck 3 and a front surface side of the main body portion 2; a bridge portion 8 fixed in a substantially center on the front surface side of the main body portion 2; a plurality of strings 4*a* supported by the bridge portion 8 and tensioned along a longitudinal direction of the fingerboard 4; and a chinrest 6 fixed with end pins 5 to an end portion of the main body portion 2, on a side opposite to the neck 3. Further, an instrument 1 as the rubbed string instrument includes bows 7 (see FIG. 2 and FIG. 8). Each of the bows 7 includes: a stick 7*a*; and a bow hair 7*b* tensioned along a longitudinal direction of the stick 7*a* in parallel to the stick 7*a*.

First, the main body case 20 is described with reference to FIG. 1 to FIG. 3, and FIG. 5. The main body case 20 is defined by an upper surface 21 and a lower surface 22 (see FIG. 5) extending by a predetermined length so as to be long to one direction and having a larger width, and by both side surfaces 23 and 24 (see FIG. 1 and FIG. 3) having a smaller width. The both side surfaces 23 and 24 are orthogonally connected to end portions of the upper surface 21 and the lower surface 22. Further, the main body case 20 includes both ends in a longitudinal direction thereof, which are connected to both end surfaces 25 and 26 (see FIG. 5). In this manner, the main body case 20 forms a cylindrical shape as a whole.

Further, of the main body case 20, the upper surface 21 and a portion ranging from a middle portion in the longitudinal direction of the both side surfaces 23 and 24 to a vicinity of the one end surface 25 are cut out. In this way, the opening portion 27 is formed. The opening portion 27 is defined by width-direction-portions 21*a* and 21*b*, longitudinal-direction-portions 23*c* and 24*c*, and inclined portions 23*a*, 24*a*, 23*b*, and 24*b*. The width-direction-portions 21*a* and 21*b* extend along a width direction of the main body case 20 at the middle portion in the longitudinal direction of the upper surface 21 of the main body case 20 and at the vicinity of the one end surface 25, respectively. The longitudinal-direction-portions 23*c* and 24*c* extend in the longitudinal direction at a middle portion in a height direction of the both side surfaces 23 and 24 of the main body case 20. The inclined portions 23*a*, 24*a*, 23*b*, and 24*b* are obliquely inclined and link both ends of the width-direction-portions 21*a* and 21*b* of the upper surface 21 and both ends of the longitudinal-direction-portions 23*c* and 24*c* of the both side surfaces 23 and 24 to each other. The inclined portions 23*a*, 24*a*, 23*b*, and 24*b* are inclined toward a center of the longitudinal-direction-portions 23*c* and 24*c* corresponding to the inclined portions 23*a*, 24*a*, 23*b*, and 24*b*.

The opening portion 27 is formed as described above, and hence it is possible to set the opening portion 27 of the main body case 20 to be large as possible, to thereby smoothly take the instrument 1 in and out of the instrument housing case 10. Further, it is possible to maintain strength of the main body case 20.

As described above, the main body case 20 includes the larger-width upper surface 21 and the larger-width lower surface 22, and the smaller-width both side surfaces 23 and 24 orthogonal to the larger-width upper surface 21 and the larger-width lower surface and 22, and forms a flat shape as a whole. Therefore, it is possible to set the opening portion 27 to have as large opening width as possible without deteriorating stiffness of the main body case 20, to thereby readily take the instrument 1 in and out of the instrument housing case 10. Note that, forming the flat shape as a whole means extending long in one direction so as to form a flat shape when viewed from the end surface 25 or 26 side. For example, the both end surfaces 25 and 26 may form so as to have a lateral wide square shape or an oval shape having a large diameter and a smaller diameter, while the upper and lower surfaces and the both side surfaces forming correspondingly to the shape of the both end surfaces 25 and 26.

Figure 8:
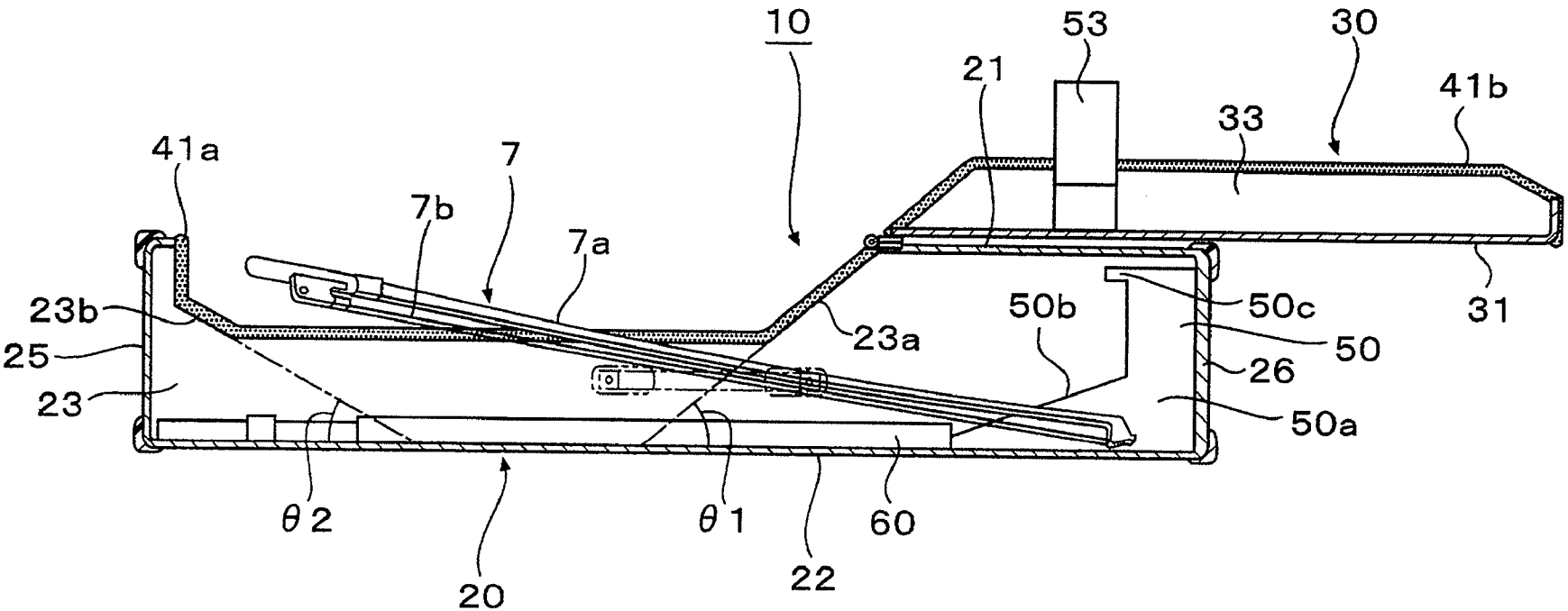
FIG. 8 is a side explanation view illustrating a state in which a bow is being taken out of the main body case.
Figure 9:
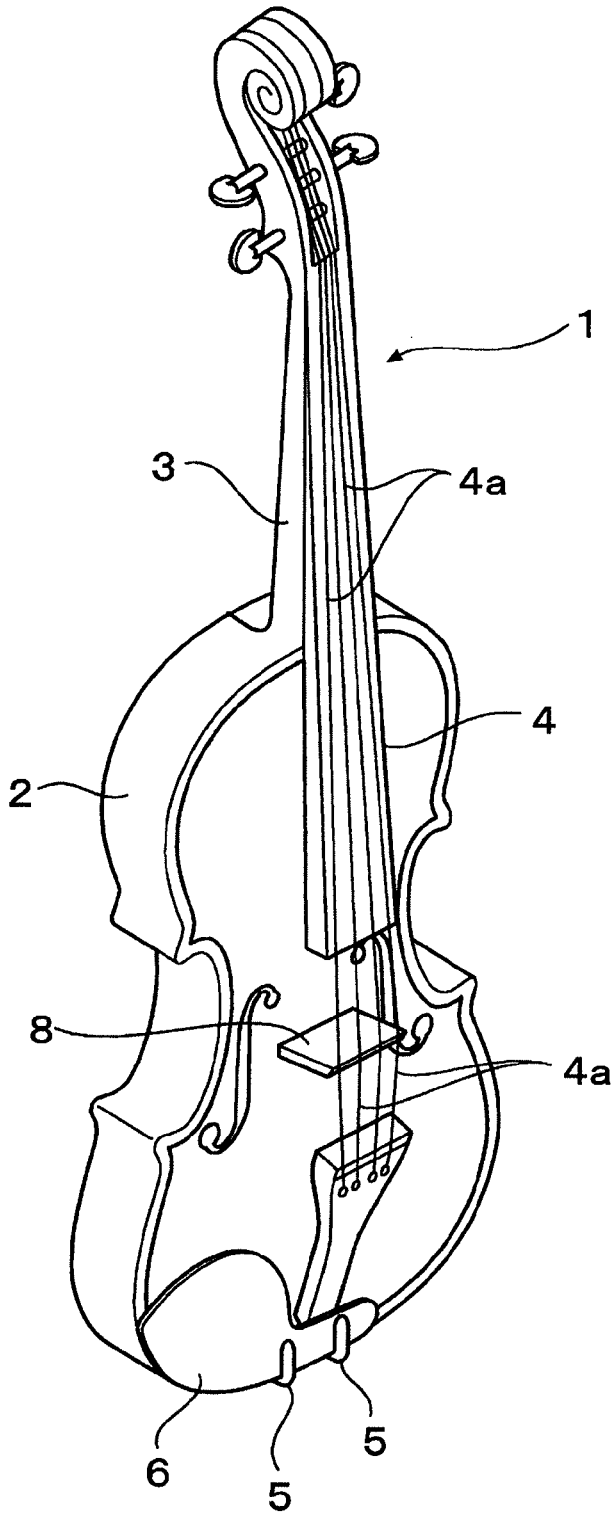
FIG. 9 is a perspective view illustrating one example of the instrument to be housed in the instrument housing case according to the embodiment of the present invention.

Further, as illustrated in FIG. 8, an angle θ1 of the inclined portions 23*a* and 24*a* with respect to the lower surface 22 of the main body case 20 is preferably set to range from 0 to 90°, and is more preferably set to range from 30 to 90°. Also, an angle θ2 of the inclined portions 23*b* and 24*b* with respect to the lower surface 22 of the main body case 20 ranges preferably from 0 to 90°, and more preferably, from 30 to 90°. As the above-mentioned angles θ1 and θ2 are closer to the right angle, the opening portion 27 becomes larger. Therefore, in this case, it is easier to take the instrument out of the instrument housing case, and the strength of the main body case 20 tends to decrease. In contrast, as the above-mentioned angles θ1 and θ2 are smaller, the strength of the main body case 20 increases, but it is more difficult to take the instrument out of the instrument housing case. Note that, the inclined portions 23*a*, 24*a*, 23*b*, and 24*b* may form curved lines such as circular arc lines.

Figure 3:
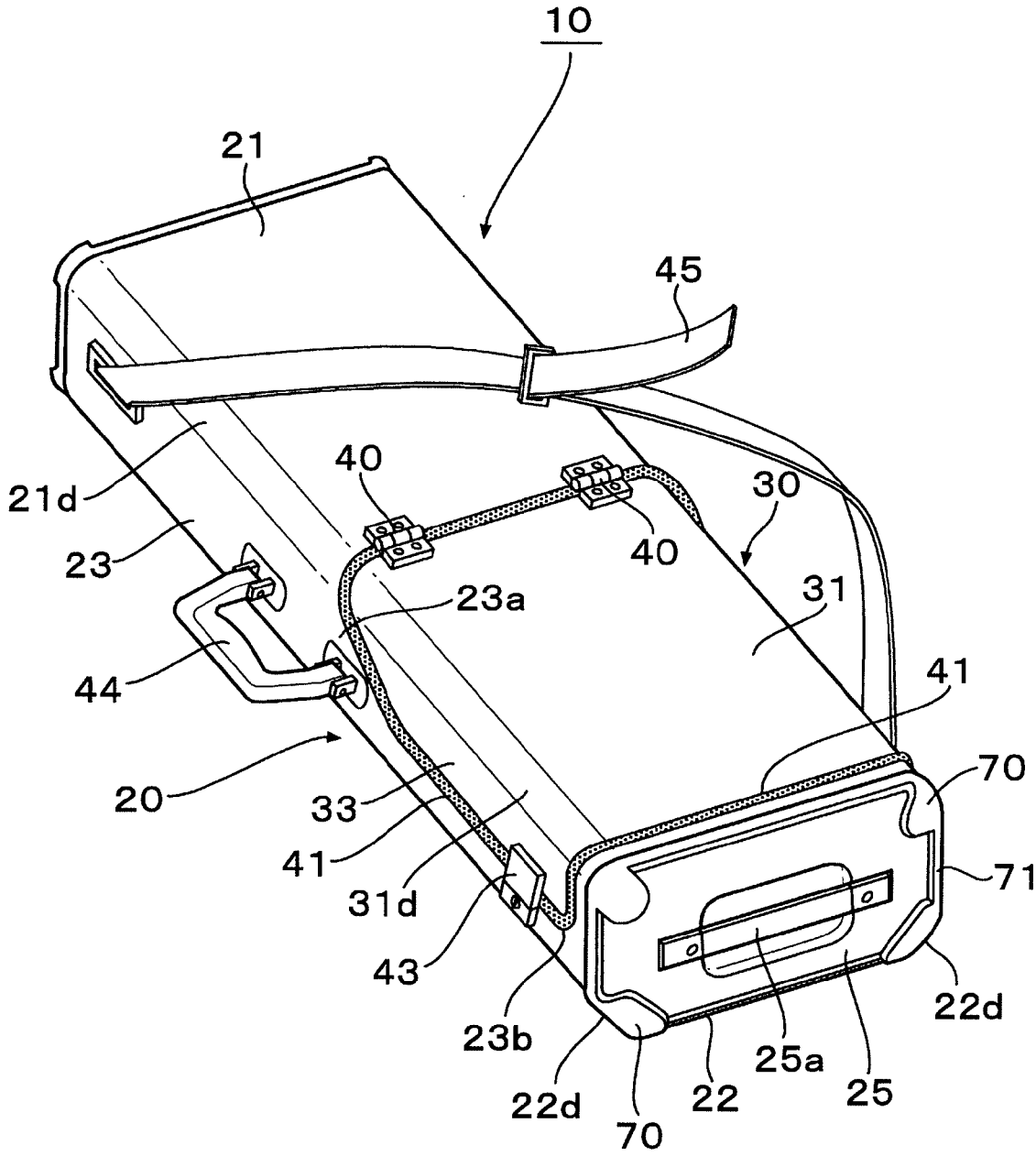
FIG. 3 is a perspective view of the instrument housing case according to the embodiment of the present invention in a state in which an opening portion thereof is closed.

In addition, the main body case 20 forms a shape in which both side corner portions 22*d* and 22*d* of the smaller-width lower surface 22 are chamfered by predetermined angles when viewed from the both end surfaces in the longitudinal direction thereof (see FIG. 3). As a result, the entire main body case 20 is formed so as to be thinner and slimmer. In this way, it is possible to reduce the weight and size of the instrument housing case. Meanwhile, both side corner portions 21*d* and 21*d* of the upper surface 21 of the main body case 20 and both side corner portions 31*d* and 31*d* of the cover body 30 described later form a rounded circular arc shape.

As illustrated in FIG. 1, the end surface corner portions in the longitudinal direction of the main body case 20 are provided with protective layers 70 formed of elastic resins such as urethane resins, fluororubbers, or silicone rubbers. Here, onto outer peripheries of the both end surfaces 25 and 26 in the longitudinal direction of the main body case 20, there are mounted frame bodies 71 of elastic resins, respectively. The protective layers 70 are provided so as to extend from the corner portions toward a center of each of the end surfaces 25 and 26. In this manner, each of the corner portions of the end surfaces 25 and 26 is protected. The above-mentioned protective layers 70 are provided, and hence, when the instrument housing case 10 falls down or something bumps against the instrument housing case 10, and the impact force is applied to the instrument housing case 10, it is possible to suppress the impact force so as to prevent the instrument housing case 10 from being damaged.

In addition, in a center portion in the longitudinal direction of the one side surface 23 of the main body case 20, there is fixed a grip handle 44 to be gripped for carrying the instrument housing case 10 in a laid posture. In addition to the grip handle 44, there is provided a shoulder strap 45 for carrying the main body case 20 on the back of a user thereof in a state in which the longitudinal direction of the main body case 20 is oriented in the vertical direction. One end of the shoulder strap 45 is fixed to a vicinity of the end surface 26 of the side surface 23 of the main body case 20, and the other end of the shoulder strap 45 is fixed to a position, which is obliquely opposed to the fixing position of the one end, of the cover body 30 (see FIG. 3). Note that, the shoulder strap 45 may be obliquely fixed to, for example, the both ends in the longitudinal direction of the lower surface 22, and a fixing way is not especially limited. Further, as illustrated in FIG. 1, in the center of the one end surface 25 of the main body case 20, there is fixed a slide-type grip handle 25*a*. With this, it is possible to grip the slide-type grip handle 25*a* for carrying the instrument housing case 10 in an upright posture.

Meanwhile, the cover body 30 in this embodiment forms a shape adapted for the opening portion 27 of the main body case 20. The cover body 30 includes a front wall 31 and both side walls 33 and 34. The front wall 31 forms a surface obtained by extending the upper surface 21 of the main body case 20. The both side walls 33 and 34 form surfaces obtained by extending the both side surfaces 23 and 24 of the main body case 20. The both side walls 33 and 34 form shapes bent from width-direction both side edges of the front wall 31 through the rounded both side corner portions 31*d* and 31*d* so as to be orthogonal to the front wall 31. Both end portions in the longitudinal direction of the both side walls 33 and 34 form shapes obliquely cut out so as to be aligned with each of the inclined portions 23*a*, 24*a*, 23*b*, and 24*b* of the main body case 20.

Further, as illustrated in FIG. 3, when the opening portion 27 is closed by pivoting the cover body 30, the front wall 31 of the cover body 30 is aligned with the upper surface 21 of the main body case 20 so as to form the same smooth surface including no step together with the upper surface 21. In the same time, the both side walls 33 and 34 of the cover body 30 are also aligned with the both side surface 23 and 24 of the main body case 20 so as to form the same smooth surfaces including no step together with the both side surface 23 and 24.

Further, in an edge portion of one end of the cover body 30 and one of the edge portions (one of the edge portions, which is closer to the end surface 26) of the opening portion 27 of the main body case 20, which is further away from the end surface 25, there are fixedly provided two pairs of hinges 40 and 40 which are disposed at a predetermined interval. Through the hinges 40, the cover body 30 is fixed with respect to the main body case 20 so as to be pivotable in the vertical direction. Note that, the hinges 40 may be arranged on a back side of the main body case 20 and the cover body 30 for the purpose of preventing the hinges from being seen from the outside when the opening portion 27 is closed by downwardly pivoting the cover body 30. Also their structures are not especially limited.

Further, by downwardly pivoting the cover body 30, the obliquely cut out both end portions of the both side walls 33 and 34 of the cover body 30 come into contact with the respective inclined portions 23*a*, 24*a*, 23*b*, and 24*b* of the opening portion 27 of the main body case 20. At the same time, the corresponding end portions of the cover body 30 come also into contact with the width-direction portions 21*a* and 21*b* and the longitudinal-direction portions 23*c* and 24*c* of the main body case 20, to thereby close the opening portion 27.

As described above, the opening portion 27 of the main body case 20 is closed with the cover body 30. In this case, the respective end portions of the main body case 20 and the respective end portions of the cover body 30 come into contact with each other, and thus a fitting line 41 is formed.

Figure 4:
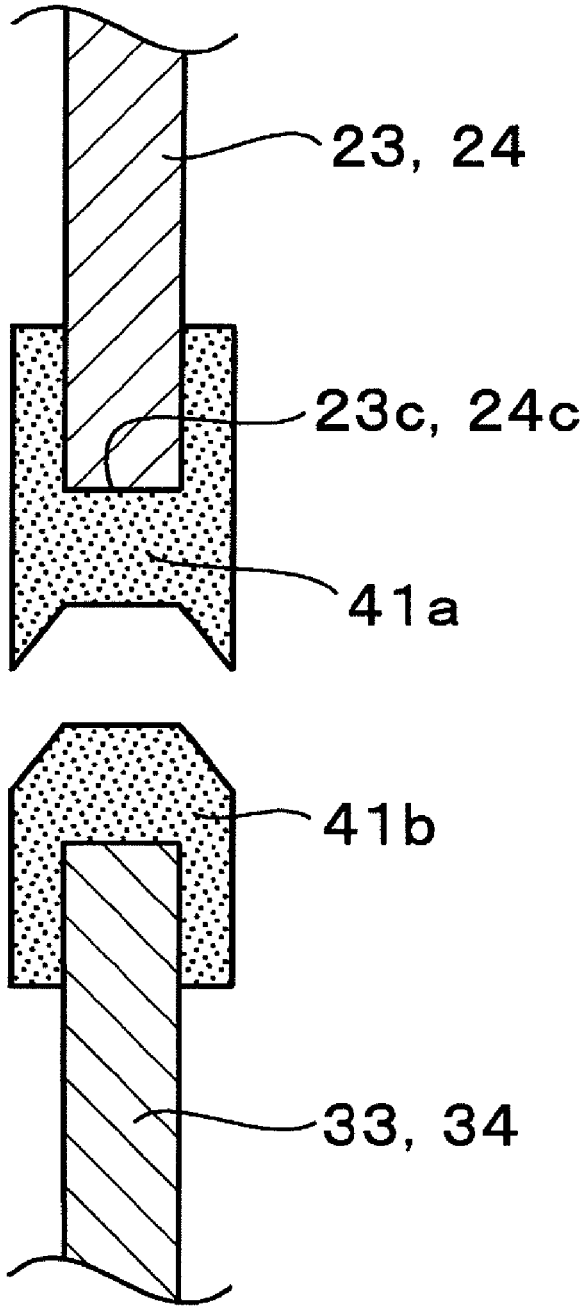
FIG. 4 is a partially enlarged explanation view illustrating a vicinity of a fitting line of the instrument housing case according to the embodiment of the present invention.

Further, it is preferred that the fitting line 41 be provided with the following members. FIG. 4 is a cross-sectional view of the fitting line 41 between the main body case 20 and the cover body 30. As illustrated in FIG. 4, in the longitudinal-direction portions 23*c* and 24*c* of the both side surfaces 23 and 24 of the main body case 20 and the corresponding end portions of the both side walls 33 and 34 of the cover body 30, there are provided elastic members 41*a* and 41*b* each formed of an elastomer, a rubber, or the like. A contact surface of the elastic member 41*a* is recessed. A contact surface of the elastic member 41*b* has a convex shape adapted for the recessed portion of the elastic member 41*a*. The above-mentioned elastic members 41*a* and 41*b* are formed in an entire periphery of the fitting line 41.

Therefore, by downwardly pivoting the cover body 30, the convex portion of the elastic member 41*b* fits elastically into the recessed portion of the elastic member 41*a*. Thus, while the fitting line 41 is formed in a state in which the main body case 20 and the cover body 30 are held in close contact with each other, the opening portion 27 of the main body case 20 is closed (see FIG. 3). As a result, through the two elastic members 41*a* and 41*b*, the cover body 30 is closed. Thus, it is possible to further increase a sealing property of the opening portion 27, to thereby prevent the moisture and the like from getting into the instrument housing case 10 from the outside. Note that, the recessed portion may be provided to the elastic member 41*b* and the convex portion may be provided to the elastic member 41*a*. In addition, a shape of each of the elastic members is not limited to those illustrated in FIG. 4, and another structure may be employed.

Further, to the above-mentioned main body case 20 and cover body 30, there are provided fasteners 43 for locking the cover body 30 in a closed state when the opening portion 27 is closed by pivoting the cover body 30. In this embodiment, the fasteners 43 and 43 are fixed at positions closer to the end surface 25 of the fitting lines 41 and 41 along the both side surfaces 23 and 24 of the instrument housing case 10, respectively (see FIG. 1 and FIG. 3).

The above-mentioned main body case 20 and cover body 30 are formed of a thermosetting resin such as an epoxy resin, an unsaturated polyester resin, a vinyl ester resin, and a polyimide resin, or a thermoplastic resin such as a polyethylene, a polypropylen, a polytetrafluoroethylene, a polycarbonate, an acrylic resin, a nylon, and an acrylonitrile-butadiene-styrene (ABS) resin. In this case, the above-mentioned main body case 20 and cover body 30 are preferably formed of a resin reinforced with reinforced fiber, and more preferably, of a resin reinforced with woven fabric containing carbon fiber. By using the above-mentioned fiber reinforced resin, it is possible to provide the instrument housing case 10 having light weight and high stiffness.

It is possible to house, in the instrument housing case 10 having the above-mentioned structure, the instrument 1 as the rubbed string instrument as illustrated in FIG. 8. The above-mentioned instrument 1 is applied with multi-layer paint such as varnish and a polyurethane for the purpose of improving an acoustic property of the instrument 1 and protecting the instrument 1 from the moisture. The above-mentioned paint takes at least several months to be completely dried. During a time period until the paint is completely dried, it is desired to house the instrument 1 in the instrument housing case 10 so that other members do not come into contact with painted surfaces.

In order to solve the above-mentioned problem, in the instrument housing case 10 according to this embodiment, the following internal structure is employed. In the following, an internal structure of the instrument housing case 10 is described.

As illustrated in FIG. 2 and FIG. 5 to FIG. 8, of the inner surface on the end surface 26 side of the main body case 20, in a center in a width direction of the larger-width upper surface 21 and the larger-width lower surface 22, there is provided a first retaining portion 50 for supporting a vicinity of end pins 5 of the instrument 1.

A portion adjacent to the end surface 26 in the lower surface 22 of the main body case 20 is provided with an inclined surface 50*b*. The inclined surface 50*b* gradually increases in height toward the end surface 26 so as to reach a lower portion 50*a* of the first retaining portion 50. Further, a rib-like engaging portion 50*c* is provided so as to protrude from the end portion on the upper surface 21 side of the first retaining portion 50. The rib-like engaging portion 50*c* is a portion engaging to the back side of the end pins 5 of the instrument 1 (see FIG. 5).

Figure 5:
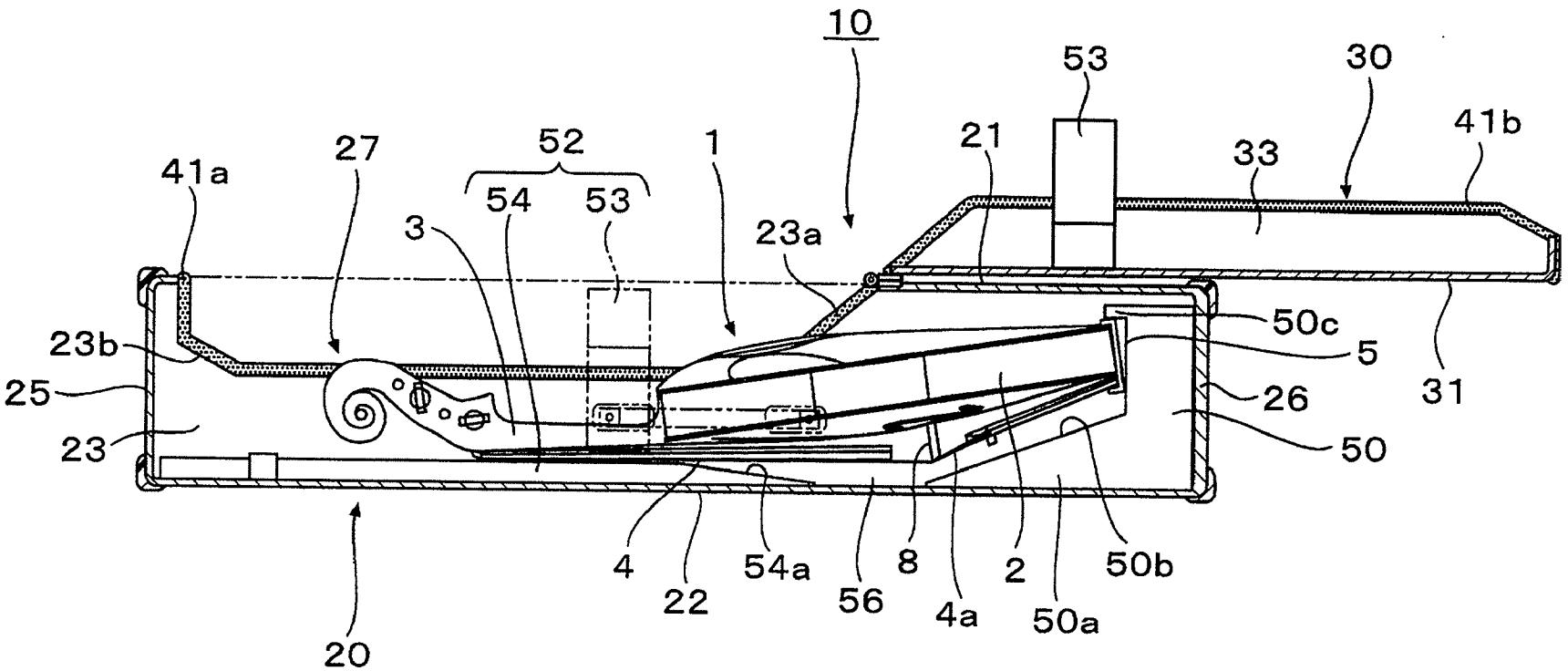
FIG. 5 is a side explanation view illustrating a state in which the opening portion is completely opened by pivoting a cover body by approximately 180° in a horizontal position and an instrument is housed in the instrument housing case according to the embodiment of the present invention.
Figure 6:
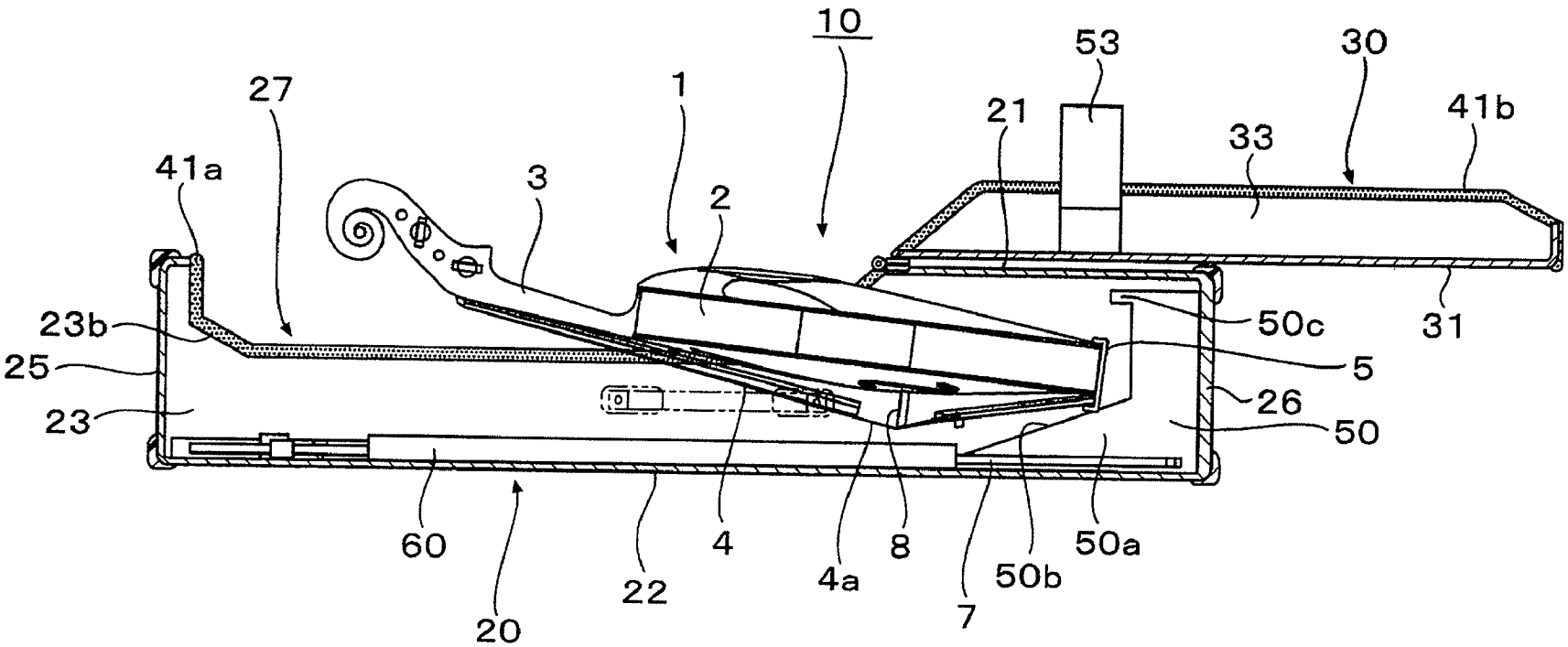
FIG. 6 is a side explanation view illustrating a state in which the instrument is being taken out of a main body case in the instrument housing case according to the embodiment of the present invention.
Figure 7:
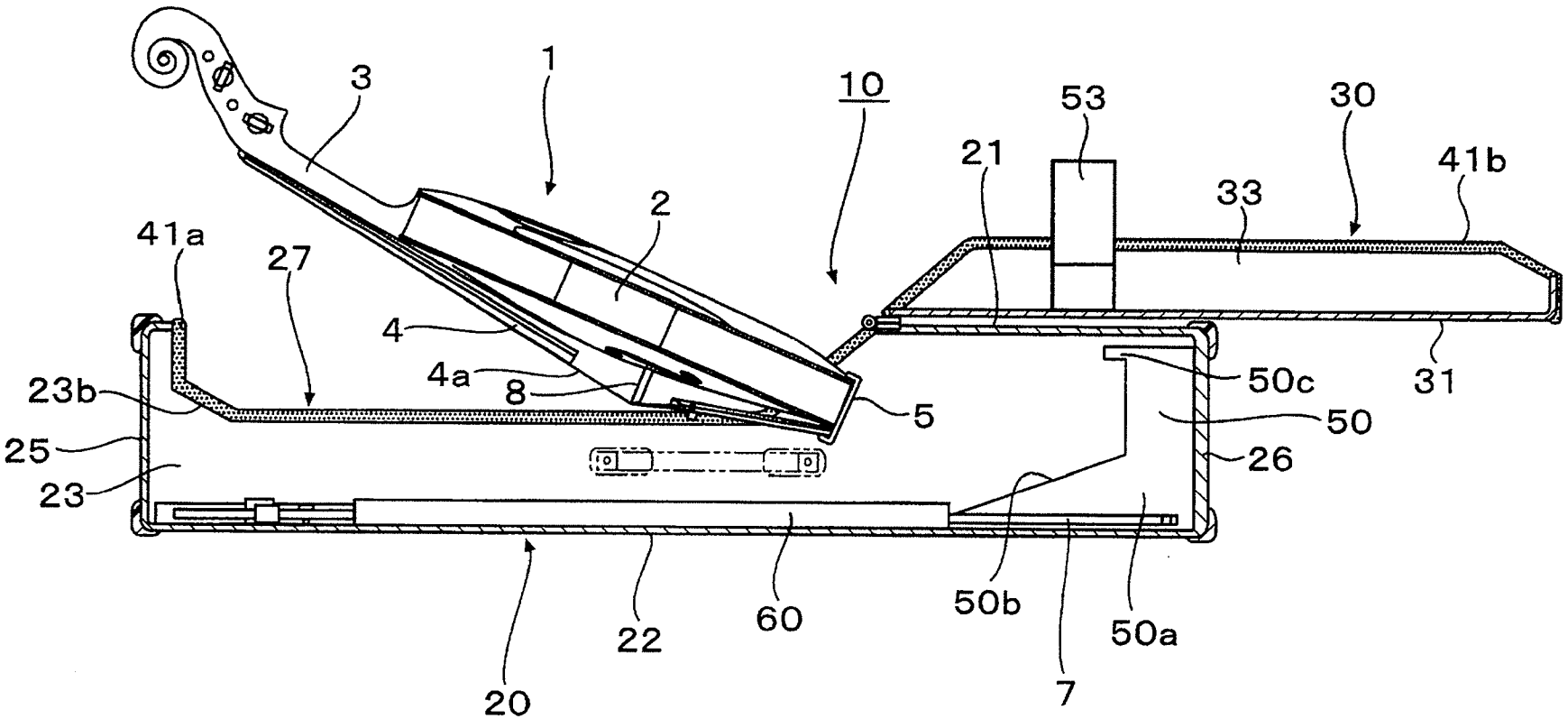
FIG. 7 is a side explanation view illustrating a state in which the instrument is further pulled out from the state illustrated in FIG. 6.

As illustrated in FIG. 2 and FIG. 5, on an inner surface of the main body case 20 opposed to the cover body 30 and on an inner surface of the cover body 30, there is provided a second retaining portion 52 for sandwiching the neck 3 of the instrument 1. The second retaining portion 52 includes a first holding member 53 and a second holding member 54. The first holding member 53 is fixed on the inner surface of the cover body 30, and holds a back surface side of the neck of the instrument 1. The second holding member 54 is fixed on the inner surface of the main body case 20, and the fingerboard 4 on a front side of the neck of the instrument 1 comes into contact with the second holding member 54. The fingerboard 4 is supported in substantially parallel to the inner surface of the main body case 20.

As illustrated in FIG. 1, a base portion of the first holding member 53 is fixed to the both side walls 33 and 34 of the cover body 30. The first holding member 53 protrudes toward an inside of the instrument housing case by a predetermined height. In its protruding end portion, there is formed a holding recessed portion 53*a* corresponding to the shape of the neck, and both sides of the holding recessed portion 53*a* form shoulder portions 53*b* and 53*b* rounded so as to have circular arcs. The first holding member 53 comes into contact with an edge portion on a side opposite to the end pins 5 of the main body portion 2 of the instrument 1 from the back surface side when the cover body 30 is closed, to thereby hold the main body portion 2 against the first retaining portion 50.

Meanwhile, the second holding member 54, as illustrated in FIG. 2, is provided at a position, which is corresponding to the first holding member 53 of the cover body 30, of the lower surface 22 of the main body case 20. The second holding member 54 is arranged in the center in the width direction of the lower surface 22, and extends in the longitudinal direction so as to form a plate shape having the same width as that of the first retaining portion 50. Further, the end surface 26 side of the second holding member 54 forms a tapered shape gradually decreasing in height toward the end surface 26. Thus, there is formed a recessed portion 56 between the second holding member 54 and the first retaining portion 50 of the lower surface 22 of the main body case 20. With the recessed portion 56, when the rubbed string instrument is taken in and out of the instrument housing case or when the rubbed string instrument is housed and retained in the instrument housing case, the bridge portion 8 of the rubbed string instrument is not held in contact with the inner surface of the instrument housing case (see FIGS. 2 and 5).

In addition, a pair of neck retaining portions 55 and 55 are provided so as to protrude in the both side edge portions on the recessed portion 56 side of the upper surface of the second holding member 54 (see FIG. 2). The pair of neck retaining portions 55 and 55 retain the neck 3 of the instrument 1 from both side portions thereof upon housing in the instrument housing case. In this way, it is possible to prevent the neck 3 from being laterally offset, etc. Note that, an inner surface of each of the pair of neck retaining portions 55 forms a tapered shape. In this way, it is easy for the pair of neck retaining portions 55 and 55 to receive the neck 3 therein.

Further, as illustrated in FIG. 2, on the both side portions of the inner surface of the lower surface 22 of the main body case 20, there are fixed guide wall portions 60 for regulating both side positions of the bows 7 as accessories of the instrument 1. An inside of each of the guide wall portions 60 forms a housing portion 48 for housing the bow 7. Each of the guide wall portions 60 forms a square column shape including a cavity 61 formed therein, and extends from the first retaining portion 50 up to the second retaining portion 52. Between an end portion on the first retaining portion 50 side of each of the guide wall portions 60 and the first retaining portion 50, there are arranged bow supporting portions 62 and 62.

Further, on the both sides in a vicinity of the end surface 25 of the main body case 20 of the plate-like second holding member 54, there are fixed bow supporting portions 63 and 63. Each of the bow supporting portions 63 and 63 includes a groove portion opened toward the inside of the instrument housing case. On a deep side (end surface 26 side) of the instrument housing case with respect to the bow supporting portions 63 and 63, there are mounted fixtures 49 for detachably fixing the bows 7 in the instrument housing case. As illustrated in FIG. 2, each of the fixtures 49 includes a plate-like base portion 49*a* and a plate-like rotary clamp portion 49*b*. The plate-like base portion 49*a* is fixedly provided in the lower surface 22 of the main body case 20. The plate-like rotary clamp portion 49*b* is rotatably fixed with respect to the base portion 49*a*. Further, in a normal state, the rotary clamp portion 49*b* remains being rotated in the same direction with respect to the base portion 49*a*. In order to retain each of the bows 7 housed in the housing portion 48, after the rotary clamp portion 49*b* is sandwiched between the stick 7*a* and the bow hair 7*b* of the bow 7, the rotary clamp portion 49*b* is rotated by 90° with respect to the base portion 49*a*. In this way, the bow 7 can be locked and retained (see FIG. 2). By the fixtures 49 and the above-mentioned guided wall portions 60, a bow-retaining portion according to the present invention is constituted.

Further, the instrument 1 is housed and retained in the instrument housing case 10 as follows. Specifically, the bottom portion of the instrument 1 is supported by the first retaining portion 50 and the neck 3 of the instrument 1 is sandwiched by the second retaining portion 52 including the first holding member 53 and the second holding member 54 (see FIG. 5). The above-mentioned process is performed in such a manner that an area in which the painted surface of the instrument 1 is held in contact with the inner surface of the instrument housing case 10 is preferably 10% or less of the entire painted surface, and more preferably, 3% or less. Further, each of the retaining portions 50 and 52 is formed of a soft material having cushioning characteristics such as polyurethane foam.

Next, a using method for the instrument housing case 10 structured as described above according to the present invention is described.

In order to house the instrument 1 in the instrument housing case 10, the cover body 30 is upwardly pivoted so as to open the opening portion 27 (see FIG. 1).

Further, as illustrated in FIG. 2, each of the bows 7 is inserted into the bow-retaining portion. In this time, the lower end portion of the bow 7 is inserted until the lower end portion of the bow 7 comes into contact with the bow supporting portion 62, and the upper end portion of the stick 7*a* of the bow 7 is caused to fit into the groove portion of the bow supporting portion 63. After that, the rotary clamp portion 49*b* of the fixture 49 is rotated by 90° with respect to the base portion 49*a*. In this way, the bow 7 can be retained in the bow-retaining portion. As described above, it is possible to retain the bow 7 by the bow-retaining portion, and to house components such as auxiliary strings of the bow 7 in the cavity 61 of the guide wall portion 60 constituting the bow-retaining portion. Therefore, it is possible to increase a convenience for a user of the instrument housing case.

After that, the instrument 1 is inserted into the main body case 20 while the back surface of the instrument 1 is oriented to the opening portion side so that the main body portion 2 side of the instrument 1 is first inserted in the opening portion 27. Then, through the inclined surface 50*b* provided in front of the first retaining portion 50, the end pins 5 side of the instrument 1 is guided and gradually moves into the instrument housing case. After that, when the end pins 5 are pushed thereinto until the end pins 5 come into contact with the first retaining portion 50, as illustrated in FIG. 5, a vicinity of the end pins 5 is supported by the first retaining portion 50 in a state in which the end pins 5 side of the instrument 1 is lifted up along the inclined surface 50*b*. At the same time, the neck 3 of the instrument 1 is inserted into a pair of neck retaining portions 55 and 55 on the second holding member 54, and the fingerboard 4 of the instrument 1 is caused to come into contact with the plate-like second holding member 54.

As described above, in this embodiment, the above-mentioned inclined surface 50*b* is provided, and hence the thin neck 3 side extending from the main body portion 2 is arranged substantially along the inner surface of the main body case and the end pins 5 side is lifted up toward the inside of the instrument housing case with respect to the neck 3 side. Thus, it is possible to house and retain the instrument 1 in the instrument housing case in a balanced stable posture. Further, in the above-mentioned state, the rib-like engaging portion 50*c* is engaged to the back side of the end pins 5 of the instrument 1, to thereby prevent the instrument 1 from being lifted up (see FIG. 5).

Next, the cover body 30 is downwardly pivoted. Then, the neck 3 of the instrument 1 is fitted into the holding recessed portion 53*a* of the first holding member 53. At the same time, both the shoulder portions 53*b* and 53*b* of the first holding member 53 come into contact with the edge portion on the side opposite to the end pins 5 of the main body portion 2 of the instrument 1 from the back surface side. Then, the main body portion 2 is pushed toward the first retaining portion 50, and the neck 3 is sandwiched between the first holding member 53 and the second holding member 54. In the above-mentioned state, the opening portion 27 of the main body case 20 is closed, and the instrument 1 is housed and retained in the instrument housing case (see FIG. 1). As described above, the edge portion on the side opposite to the end pins 5 is inserted by being pushed toward the first retaining portion 50 by the first holding member 53, and hence it is possible to readily and surely insert the instrument 1 into the instrument housing case 10.

By closing the cover body 30 as described above, an outer periphery of the cover body 30 comes into contact with an inner periphery of the opening portion 27 of the main body case 20 through the elastic members 41*a* and 41*b*. In this way, the opening portion 27 is closed (see FIG. 2). In this time, the elastic members 41*a* and 41*b* (see FIG. 4) respectively provided to the main body case 20 and the cover body 30 fit into each other. Thus, the fitting line 41 is formed in a state in which the main body case 20 and the cover body 30 are held in sealing contact with each other.

Further, in this embodiment, the area in which the painted surface of the instrument 1 is held in contact with the inner surface of the instrument housing case 10 is set to be 10% or less of the entire painted surface. Therefore, when the instrument 1 is retained by the first retaining portion 50 and the second retaining portion 52, it is possible to prevent, as much as possible, the painted surface of the instrument 1 from being in contact with the inner surface of the instrument housing case. As a result, it is possible to prevent the painted surface from being damaged and from having marks generated due to adhesion of a cushion member.

In addition, the second retaining portion 52 includes the first holding member 53 and the second holding member 54. The first holding member 53 holds the back surface side of the neck. The fingerboard 4 on the front side of the neck 3 comes into contact with the second holding member 54. The fingerboard 4 is supported in substantially parallel to the inner surface of the main body case 20. Thus, the back surface portion (not painted portion) of the neck 3 is held by the first holding member 53 and the fingerboard 4 (portion formed of material resistant to damages and marks) is held by the second holding member 54. Thus, it is possible to retain the instrument 1 in a state in which the painted surface thereof is not held in contact with any part. Further, the fingerboard 4 is supported in substantially parallel to the inner surface of the main body case 20, and hence it is possible to efficiently house the instrument 1 in the instrument housing case 10 because of a decrease in an unnecessary space, and to retain more stably the instrument 1 in the instrument housing case 10.

As illustrated in FIG. 5, in a state in which the instrument 1 is housed and retained in the instrument housing case, the back surface side of the neck 3 of the instrument 1 is held by the first holding member 53 and the fingerboard 4 on the front side of the neck is caused to come into contact with the second holding member 54. Thus, a front side of the strings 4*a*, which are tensioned on the front side of the neck, comes into contact with the second holding member 54, elastically. Therefore, for example, even when impacts and oscillation act from the outside of the instrument housing case, those impacts and oscillation are absorbed because of elastic force of the strings 4*a* elastically held in contact with the second holding member 54. Thus, it is possible to suppress unfavorable effects provided to the main body portion 2 and the like of the instrument 1 by a maximum degree.

In addition, in this embodiment, the recessed portion 56 for arranging the bridge portion 8 of the instrument 1 so as to prevent the bridge portion 8 from coming into contact with the inner surface of the instrument housing case is formed between the first retaining portion 50 and the second retaining portion 52. Thus, in a state in which the instrument 1 is housed and retained in the instrument housing case, it is possible to retain the bridge portion 8 while preventing the bridge portion 8 from coming into contact with the inner surface of the instrument housing case because the bridge portion 8 is positioned in the recessed portion 56 (see FIG. 5). Further, by providing of the recessed portion 56, even when the instrument 1 is taken in and out of the instrument housing case 10, the bridge portion 8 is not allowed to readily come into contact with the inner surface of the instrument housing case. As described above, by providing of the recessed portion 56, when the instrument 1 is housed in the instrument housing case and when the instrument 1 is taken in and out of the instrument housing case, it is possible to prevent the bridge portion 8 from strongly coming into contact with the inside of the instrument housing case, and it is possible to effectively protect the bridge portion 8.

Figure 10:
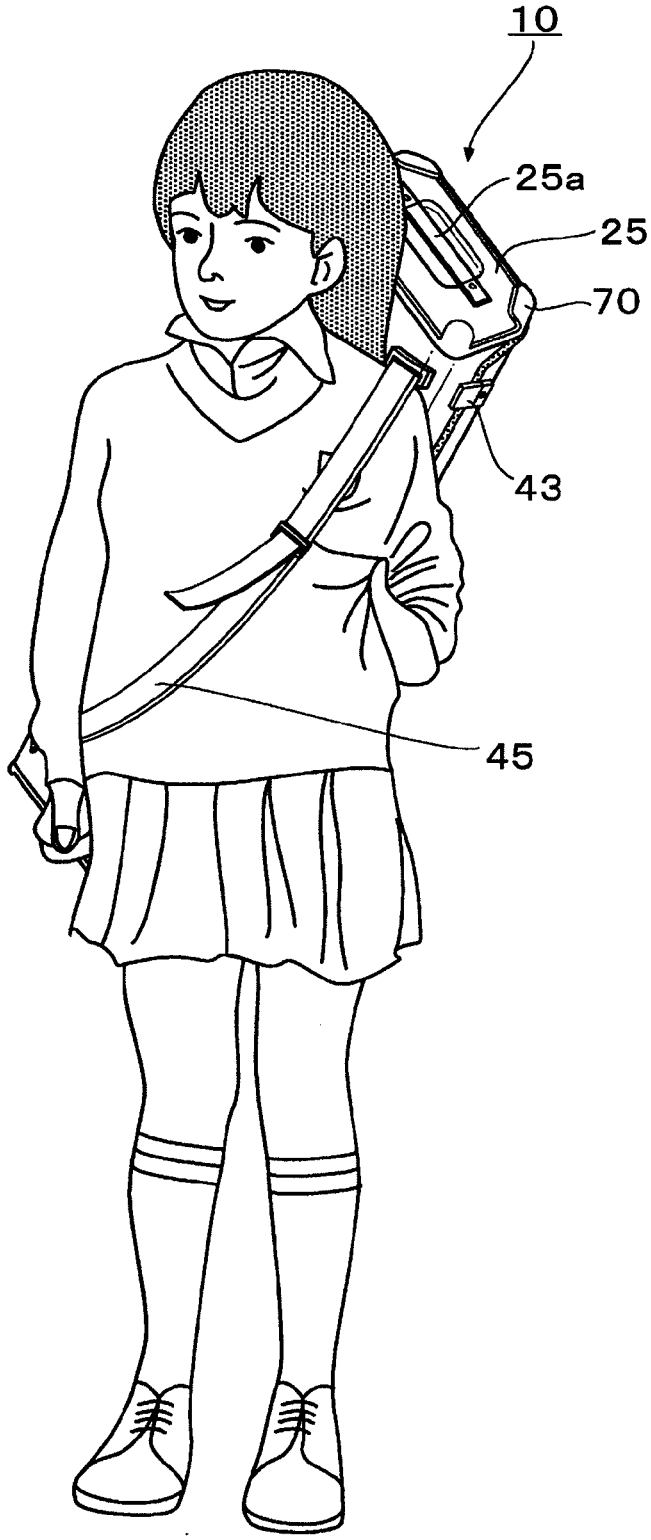
FIG. 10 is an explanation view illustrating one example upon carrying the instrument housing case according to the embodiment of the present invention.

As described above, after the opening portion 27 is closed by downwardly pivoting the cover body 30, the cover body 30 is locked in the closed state by the fasteners 43 and 43. As a result, the cover body 30 is retained so as not to be opened with respect to the main body case 20, and hence it is possible to carry the instrument housing case 10 in the laid posture while gripping the grip handle 44. Alternatively, as illustrated in FIG. 10, it is possible that a user carries the instrument housing case 10 on his or her back with the shoulder strap 45 slung over his or her shoulder in a state in which the longitudinal direction of the instrument housing case 10 is oriented in the vertical direction.

As described above, in the instrument housing case 10 in this embodiment, two kinds of carrying styles are appropriately employed. That is, it is possible not only to carry the instrument housing case 10 in the laid posture while gripping the grip handle 44 of the main body case 20, but also to retain the instrument housing case 10 remaining arranged in the upright posture by slinging the shoulder strap 45 over the shoulder of a user. Thus, it is possible to increase the convenience for a user. Further, when the instrument housing case 10 remaining arranged in the upright posture is retained, the one end surface 25 of the main body case 20 is upwardly oriented, and hence it is possible to prevent rain water and the like from readily getting into the instrument housing case.

Further, in order to take the instrument 1 out of the instrument housing case 10, the main body case 20 is placed at a predetermined position. Next, locking of the fasteners 43 is released, and the cover body 30 is opened in the longitudinal direction thereof by upwardly pivoting the cover body 30. After that, the neck 3 of the instrument 1 is gripped, and the instrument 1 is lifted obliquely upward. In this way, the instrument 1 is pulled out through the opening portion 27, and thus the instrument 1 can be taken out of the instrument housing case (see FIG. 6 and FIG. 7). Then, the rotary clamp portion 49*b* of the fixtures 49 is pivoted with respect to the base portion 49*a*, to thereby release locking against the bow 7. In this way, it is possible to take the stick 7*a* out of the bow supporting portion 63 and take the bow 7 out of the instrument housing case through the opening portion 27 (see FIG. 8).

Further, in the instrument housing case 10, since the instrument is housed in the main body case 20 including the both end surfaces closing so as to form a cylindrical shape as a whole, the instrument 1 does not easily bounce out from the opening portion 27 and the instrument 1 can be prevented from falling out of the instrument housing case even in a case where the instrument housing case is lifted up in a state in which the fasteners 43 are left unlocked after the cover body 30 is closed, or even in a case where the fasteners 43 are forced to be unlocked during conveyance. Further, the main body case 20 forms the cylindrical shape as a whole, in which the upper surface 21 and the both side surfaces 23 and 24 of the main body case 20 are partially opened, and the opening portion 27 is covered with the cover body 30. Thus, in comparison with a conventional instrument housing case having a lower case and an uppercase to open and close, it is easier to maintain the stiffness of the instrument housing case even when the instrument housing case has a relatively light weight. Therefore, it is possible to achieve a reduction in weight of the instrument housing case.

Figure 11:
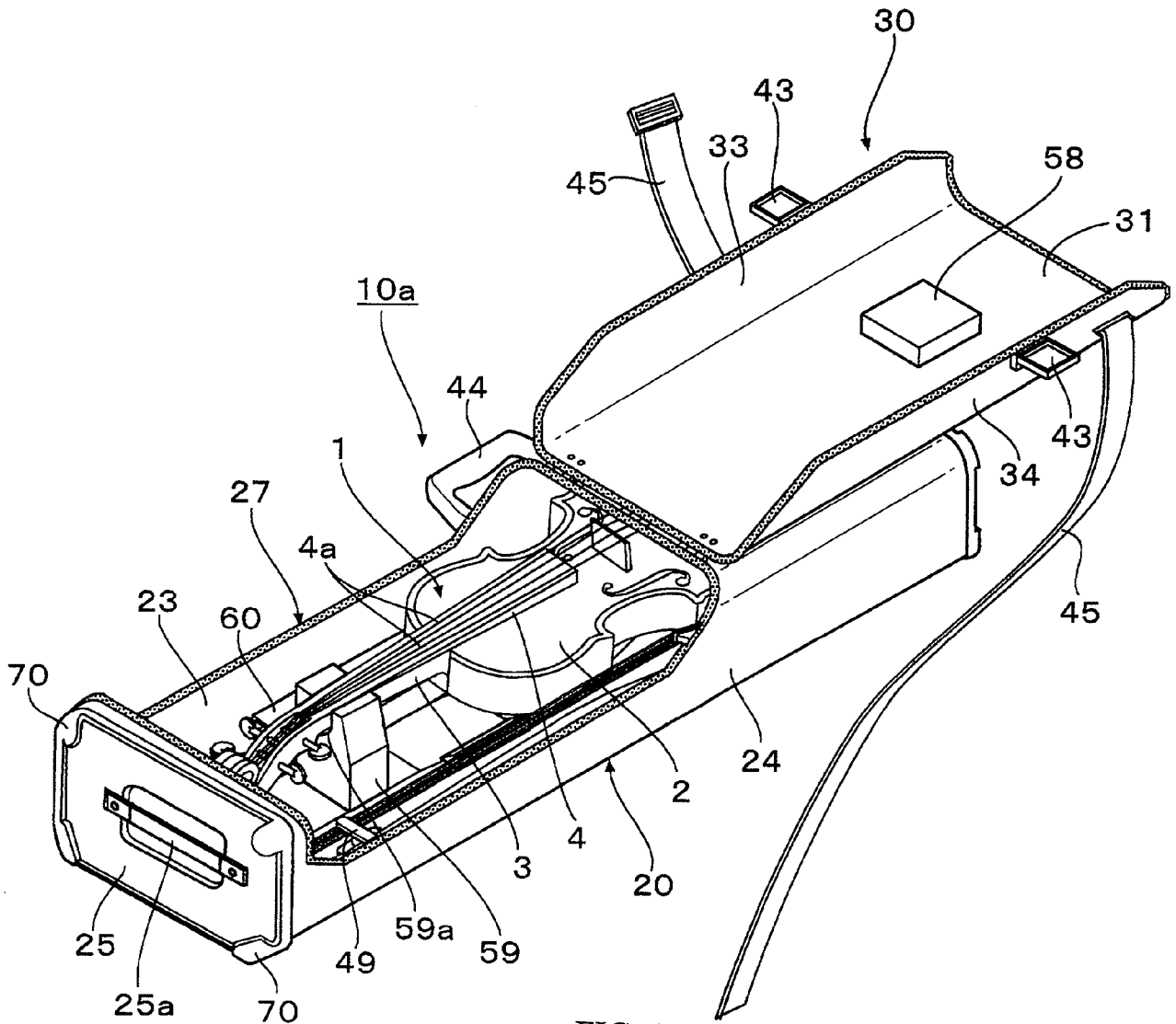
FIG. 11 is a perspective view of an instrument housing case according to another embodiment of the present invention.
Figure 12:
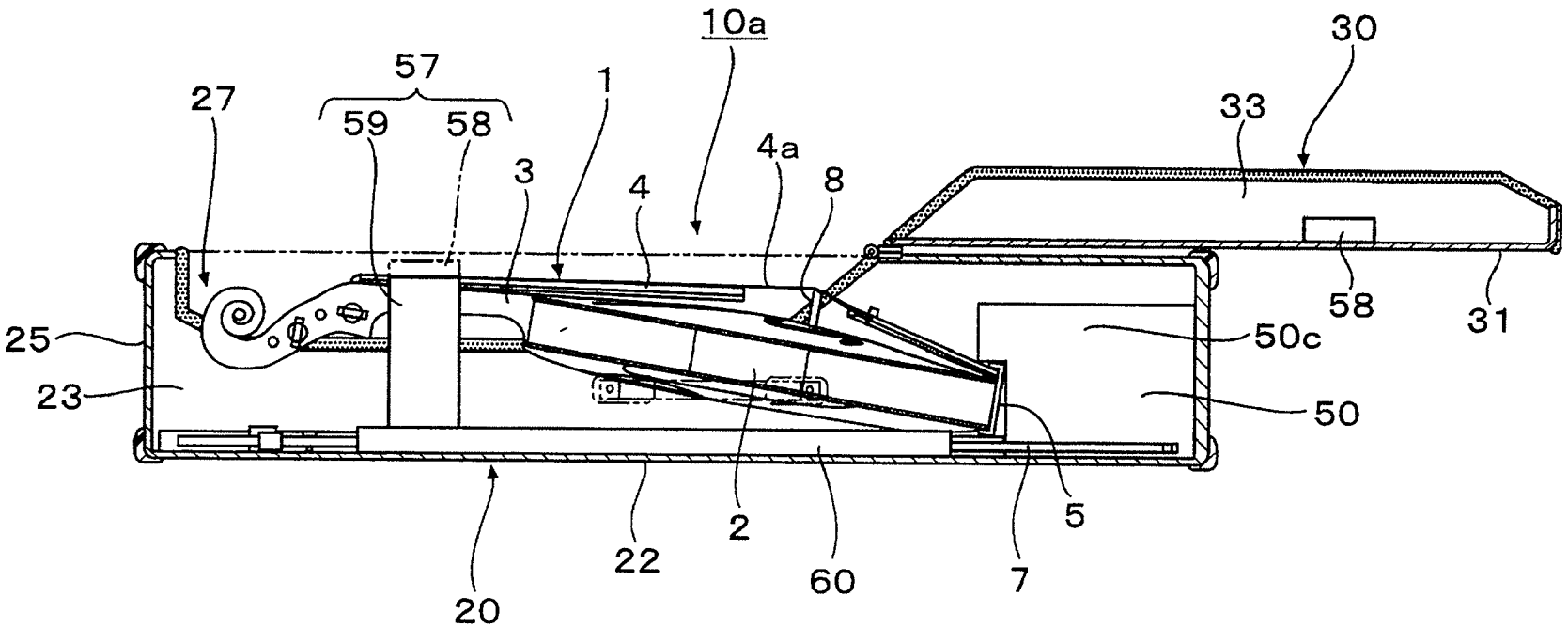
FIG. 12 is a side explanation view illustrating a state in which an instrument is housed in the instrument housing case according to the other embodiment of the present invention.
Figure 13:
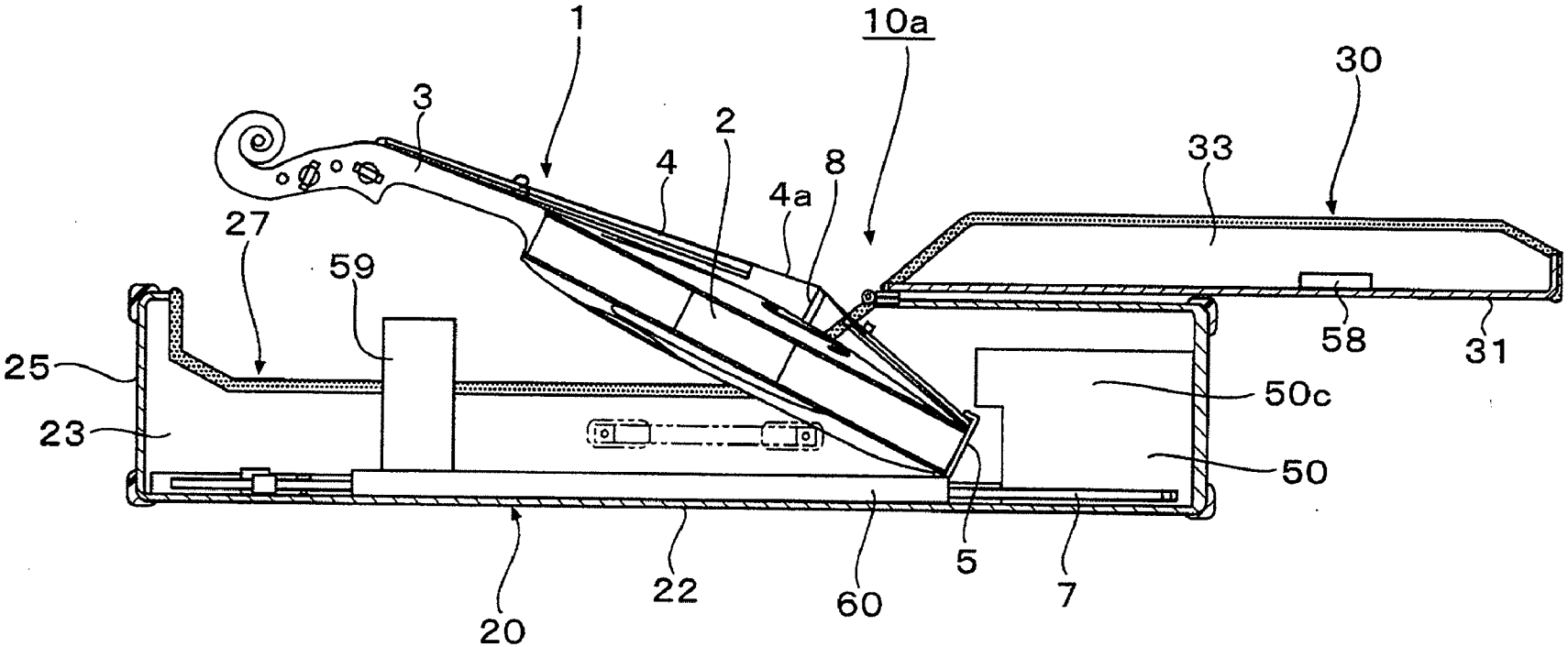
FIG. 13 is a side explanation view illustrating a state in which the instrument is being taken out of a main body case in the instrument housing case according to the other embodiment of the present invention.

FIG. 11 to FIG. 13 illustrate an instrument housing case according to another embodiment of the present invention. Note that, the substantially same portions as those of the above-mentioned embodiment are denoted by the same reference symbols, and the description thereof is omitted.

The instrument housing case 10*a* according to this embodiment is different from the instrument housing case 10 according to the above-mentioned embodiment, in which the strings 4*a* tensioned on the front side of the neck of the instrument 1 are arranged on the inner surface wide of the main body case, in that the strings 4*a* are arranged on the opening portion 27 side.

As illustrated in FIG. 11, a second retaining portion 57 for sandwiching the neck 3 of the instrument 1 in this embodiment includes a first holding member 58 and a second holding member 59. The first holding member 58 is fixed on the inner surface of the cover body 30, for holding the front side of the neck of the instrument 1. The second holding member 59 is fixed on the inner surface of the main body case 20, for supporting the back surface side of the neck of the instrument 1. The strings 4*a* on the front side of the neck of the instrument 1 are arranged on the opening portion 27 side of the main body case 20.

The first holding member 58 forms a plate shape, and protrudes from the inner surface of the front wall 31 of the cover body 30 toward the inside of the instrument housing case by a predetermined height. Meanwhile, the second holding member 59 forms a column shape having a larger width. The second holding member 59 protrudes by such a height that the second holding member 59 abuts against the first holding member 58 toward the inside of the instrument housing case when the opening portion 27 is closed with the cover body 30 from a position where the second holding member 59 is aligned with the first holding member 58 on the inner surface of the lower surface 22 of the main body case 20. In a protruding end surface of the second holding member 59, there is formed a retaining recessed portion 59*a* corresponding to the shape of the neck of the instrument 1. Note that, the first retaining portion 50 forms a shape protruding toward the inside of the instrument housing case higher than the first retaining portion 50 according the above-mentioned embodiment.

Further, in a state in which the cover body 30 is upwardly pivoted, the main body portion 2 is inserted into the opening portion 27 while the neck side of the instrument 1 is oriented toward the opening portion side. In this way, the end pins 5 are supported by the first retaining portion 50. At the same time, the neck 3 is fitted into the retaining recessed portion 59*a* of the second holding member 59 (see FIG. 12 and FIG. 13). When the opening portion 27 is closed by downwardly pivoting the cover body 30 in the above-mentioned state, the first holding member 58 comes into contact with the second holding member 59. Then, the neck 3 is sandwiched between the first holding member 58 and the second holding member 59. At the same time, the vicinity of the end pins 5 is supported by the first retaining portion 50. In this manner, the instrument 1 can be housed in the instrument housing case. Meanwhile, in order to take the instrument 1 out of the instrument housing case, the opening portion 27 is opened by upwardly pivoting the cover body 30. The neck 3 is gripped, and the instrument 1 is pulled out of the instrument housing case through the opening portion 27 (see FIG. 13). In this way, the instrument 1 can be taken out of the instrument housing case.

In this embodiment, the back surface side of the neck is held by the second holding member 59 and the front surface side of the neck is held by the first holding member 58. The strings 4*a* on the front side of the neck of the instrument 1 are arranged on the opening portion 27 side of the main body case 20. As a result, it is easier to check positions of the strings 4*a* with respect to the instrument housing case. Therefore, it is possible to take the instrument 1 in and out of the instrument housing case while taking care to prevent the strings 4*a* from coming into contact with the inner surface of the instrument housing case and the like.

What is claimed is:

1. An instrument housing case for housing an instrument which is longer in a first direction as compared to a second direction, the instrument housing case comprising:

a main body having an upper surface, a lower surface, two side surfaces and two end surfaces, wherein the upper surface and the lower surface each have a width larger than a width of the two side surfaces;

the two end surfaces each contact the upper surface, the lower surface and the two side surfaces; and the main body includes an opening ranging from a location at approximately the middle of the upper surface in a longitudinal direction to a location adjacent to one of the end surfaces, and includes a portion of the two side surfaces; and a cover body shaped to close the opening of the main body and pivotably fixed to an edge portion of the opening in the upper surface of the main body, wherein the edge portion to which the cover body is fixed is at a location closer to a center of the main body than to either of the two end surfaces.

2. An instrument housing case according to claim 1, wherein the instrument housing case is formed of a resin reinforced with woven fabric containing carbon fiber.

3. An instrument housing case according to claim 1, wherein:

the opening is defined by:

edge portions extending along a width direction of the upper surface at a location at approximately half the length of the instrument housing case in the longitudinal direction and a location adjacent to one of the two end surfaces of the main body;

edge portions extending along the longitudinal direction of the instrument housing case in the two side surfaces of the main body at locations that are approximately half the width of the two side surfaces; and obliquely inclined edge portions linking the ends of the edge portions extending in the width direction of the upper surface with the ends of the edge portions extending in the longitudinal direction of the two side surfaces;

wherein each of the obliquely inclined edge portions is inclined toward a center of each of the edge portions extending in the longitudinal direction of the instrument housing case.

4. An instrument housing case according to claim 1, further comprising:

a grip handle provided in a center portion of a side surface of the main body so as to be gripped for carrying the instrument housing case in a laid posture; and a shoulder strap for carrying the main body on the back of a user in a state in which a longitudinal direction of the main body is oriented in a substantially vertical direction, the shoulder strap comprising two ends that are either fixed to two portions of the main body that are located away from each other in the longitudinal direction, or fixed to a portion of the main body and a portion of the cover body that are located away from each other in the longitudinal direction.

5. An instrument housing case according to claim 1, wherein protection layers formed of an elastic resin are formed in corner portions of the end surfaces in the longitudinal direction of the main body.

6. An instrument housing case according to claim 1, wherein the upper surface is integral with the two side surfaces.

7. An instrument housing case for housing an instrument which is long in one direction, the instrument housing case comprising:

a main body which is defined by an upper surface, a lower surface, two side surfaces and two end surfaces, wherein the upper surface and the lower surface each have a width larger than a width of the two side surfaces, and the two end surfaces close the main body to thereby form a cylindrical shape as a whole, the main body comprising an opening portion cut out from a portion of the upper surface, the opening portion ranging from a middle portion of the upper surface in a longitudinal direction through a middle portion of the two side surfaces in a longitudinal direction to a vicinity of one of the end surfaces; and a cover body which forms a shape adapted for the opening portion of the main body and which is pivotably fixed through a hinge to an edge portion of the opening portion in the upper surface of the main body, the edge portion being away from the one of the end surfaces, wherein:

an instrument capable of being housed in the instrument housing case includes a rubbed string instrument comprising:

a main body portion;

a neck extending from the main body portion;

a bridge portion arranged on a front side of the main body portion;

a string tensioned through the bridge portion on the front side of the main body portion and on a front side of the neck; and a chinrest fixed with an end pin to an end portion of the main body portion on a side opposite to the neck; and the instrument housing case further comprises:

a first retaining portion for supporting a vicinity of the end pin provided in an inner periphery of one of the two end surfaces of the main body which is away from the opening portion;

a second retaining portion for sandwiching the neck provided on an inner surface of the main body, which is opposed to the cover body, and on an inner surface of the cover body; and an area for holding a painted surface of the instrument is held in contact with an inner surface of the instrument housing case, wherein the painted surface in contact with the inner surface is set to be 10% or less of an entire painted surface of the instrument.

8. An instrument housing case according to claim 7, wherein:

the second retaining portion comprises:

a first holding member, which is fixed on the inner surface of the cover body, and holds a back surface side of the neck of the instrument; and a second holding member, which is fixed on the inner surface of the main body, and with which a fingerboard provided on the front side of the neck of the instrument comes into contact;

wherein, the fingerboard is supported substantially parallel to the inner surface of the main body.

9. An instrument housing case according to claim 7, wherein:

the second retaining portion comprises:

a first holding member, which is fixed on the inner surface of the cover body, and holds a front surface side of the neck of the instrument; and a second holding member, which is fixed on the inner surface of the main body, and supports a back surface side of the neck of the instrument;

wherein, the front surface side of the neck of the instrument is arranged on a side of the opening portion of the main body.

10. An instrument housing case according to claim 8, wherein, at a location between the first retaining portion and the second retaining portion in the inner surface of the main body, which is opposed to the cover body, there is provided a recessed portion for arranging the bridge portion of the rubbed string instrument while preventing the bridge portion from coming into contact with the inner surface of the instrument housing case.

11. An instrument housing case according to claim 7, wherein, in a vicinity of the end surface having the first retaining portion, on an inner side of the lower surface of the main body, which is away from the opening portion, there is provided an inclined surface that gradually increases in height toward the end surface and the first retaining portion.

12. An instrument housing case according to claim 8, wherein the first holding member is structured so as to come into contact with an edge portion of the main body portion of the instrument, which is on a side opposite to the end pin, from a back surface side of the instrument when the cover body is closed, to thereby hold the main body portion against the first retaining portion.

13. An instrument housing case for housing an instrument which is long in one direction, the instrument housing case comprising:

a main body which is defined by an upper surface, a lower surface, two side surfaces and two end surfaces, wherein the upper surface and the lower surface each have a width larger than a width of the two side surfaces, and the two end surfaces close the main body to thereby form a cylindrical shape as a whole, the main body comprising an opening portion cut out from a portion of the upper surface, the opening portion ranging from a middle portion of the upper surface in a longitudinal direction through a middle portion of the two side surfaces in a longitudinal direction to a vicinity of one of the end surfaces; and a cover body which forms a shape adapted for the opening portion of the main body and which is pivotably fixed through a hinge to an edge portion of the opening portion in the upper surface of the main body, the edge portion being away from the one of the end surfaces, wherein:

bow-retaining portions are provided on both sides of the inner surface of the main body, at locations opposed to the cover body; wherein each of the bow-retaining portions comprises:

a guide wall portion for regulating both side positions of a bow; and a fixture for detachably fixing the bow to the inner surface; and at least one of the guide wall portions comprises a cavity therein so as to house components therein.

* * * * *